US005351800A

United States Patent [19]

Johnson et al.

[11] Patent Number: 5,351,800

[45] Date of Patent: Oct. 4, 1994

[54] ESCALATOR STEP AXLE ATTACHMENT ASSEMBLY

[75] Inventors: Gerald E. Johnson, Farmington; James A. Rivera, Bristol, both of Conn.

[73] Assignee: Otis Elevator Company, Farmington, Conn.

[21] Appl. No.: 82,150

[22] Filed: Jun. 28, 1993

Related U.S. Application Data

[63] Continuation of Ser. No. 914,813, Jul. 15, 1992, abandoned.

[51] Int. Cl.[5] ..... B66B 23/12

[52] U.S. Cl. ..... 198/332; 198/333

[58] Field of Search ..... 198/332, 333

[56] References Cited

U.S. PATENT DOCUMENTS

| | | | |
|---|---|---|---|
| 1,610,411 | 12/1926 | Baker | 198/332 |
| 2,033,308 | 3/1936 | Shonnard | 198/333 X |
| 2,114,805 | 4/1938 | Margles et al. | 198/332 |
| 3,789,972 | 2/1974 | Kraft | 198/333 X |
| 4,726,463 | 2/1988 | Babler | 198/333 |
| 5,072,821 | 12/1991 | Kruse et al. | 198/333 X |

FOREIGN PATENT DOCUMENTS

| | | | |
|---|---|---|---|
| 0291388 | 12/1990 | Japan | 198/333 |

*Primary Examiner*—Cheryl L. Gastineau

[57] ABSTRACT

Escalator steps are attached to their step axles by means of C-shaped clamps which are pivotally mounted on the steps and rotatable thereon to clamping positions where they embrace and clamp the step axles to the steps. One end of the clamp is then bolted to the step so that the clamp pivot pin and bolt will secure the clamps against the step axles. A cam profile is formed on a finger on the clamp, which cam profile guides the step axles into engagement with the step and clamp. A wrench-guiding tube is fixed to the step above the clamp bolt to hold the latter on the step and to ensure engagement between the bolt and an Allen wrench or other tool inserted through the step tread to bolt the clamp in place.

7 Claims, 3 Drawing Sheets

ESCALATOR STEP AXLE ATTACHMENT ASSEMBLY

This is a continuation of copennding U.S. application Ser. No. 07/914,813, filed Jul. 15, 1992, abandoned.

TECHNICAL FIELD

This invention relates to an improved fastening assembly for securing the step axles of escalators to the steps.

BACKGROUND OF THE ART

The individual steps or pallets on an escalator or moving walkway are removably secured to the step chain axles for each step. The steps can thus be disengaged from the step chain axles for service and maintenance of the escalator. Various step-axle fastening assemblies are disclosed in U.S. Pat. Nos. 2,033,308, granted Mar. 10, 1936 to H. W. Shonnard, and 2,114,805, granted Apr. 19, 1938 to S. G. Margles et al; U.S. patent application Ser. Document No. SU 1067-165 A published on Dec. 23, 1983; and Japanese Patent Application No. 64-111719, published Dec. 3, 1990.

U.S. Pat. No. 3,789,972, granted Feb. 5, 1974 to J. K. Kraft, discloses an escalator step-axle fastening assembly which includes a clamp that is pivotally mounted on the step and that ideally automatically swings into clamping engagement with the step chain axle when the latter is moved into supporting engagement with the step. The pivoting clamp is secured in place by a bolt which is threaded into the step and which is manipulated by a tool such as an Allen wrench inserted through an opening in the step tread. In practice, the pivoting clamp will often jam against the step chain axle as the latter is swung into position beneath the step, thereby necessitating that the step be lifted upward by the installer or serviceman to clear the axle for further movement. Two other problems have surfaced relating to the patented system. The first problem relates to the securement bolt becoming disengaged from the step and falling into the escalator after the step has been uncoupled from the axle. The other problem relates to the difficulty of properly engaging the tool with the bolt through the small opening in the tread.

DISCLOSURE OF THE INVENTION

This invention relates to an improved escalator step-axle fastening assembly of the same general type as that disclosed in the Kraft U.S. Pat No. 3,789,972. The fastener assembly of this invention ensured smooth assembly of the step to axle connection, prevents the fastening bolt from disengaging from the step, and provides a positive guide for engaging the fastening tool with the fastening bolt. The fastener assembly of this invention includes generally C-shaped clamps that are pivotally mounted on the step adjacent to the axle recesses. The clamps have a projecting finger formed on the end thereof, which is engaged by the axle as the latter is moved toward the axle recesses on the step. The surface of the finger is curved so as to provide a profiled cam surface or ramp which contacts the axle. As the axle approaches the stop it slides over the profiled cam surface and causes the clamp to pivot through a 180° arc to a clamping position relative to the axle. The fastening bolt is carried in a restricted guide tube which is adhered to the step. The bolt overlies a bore in the step that registers with a threaded hole in the clamp. When the clamp is fully closed, the mechanic can insert a tightening tool, such as an Allen wrench, through an opening in the step tread. The tool is guided down into the head of the fastening bolt by the restricted passage in the guide tube whereby quick and certain engagement between the tool and the fastener is assured. To secure the axle to the step, no lifting or other manipulation of the step is necessary due to the profiled camming surface on the clamp.

It is therefore an object of this invention to provide an improved fastening assembly for securing an escalator step to the step axle without the need to move or manipulate the step in any way.

It is a further object of this invention to provide a fastening assembly of the character described which positively prevents the clamp fastening bolt from becoming separated from the step when the step and axle are disconnected.

It is an additional object of this invention is to provide a fastening assembly of the character described which positively directs the assembly/disassembly tool through the step to the fastening bolt.

BRIEF DESCRIPTION OF THE DRAWINGS

These and other objects and advantages will become more readily apparent from the following detailed description of a preferred embodiment of the invention when taken in conjunction with the accompanying drawing, in which.

BEST MODE EMBODIMENT OF THE INVENTION

Figure 1:
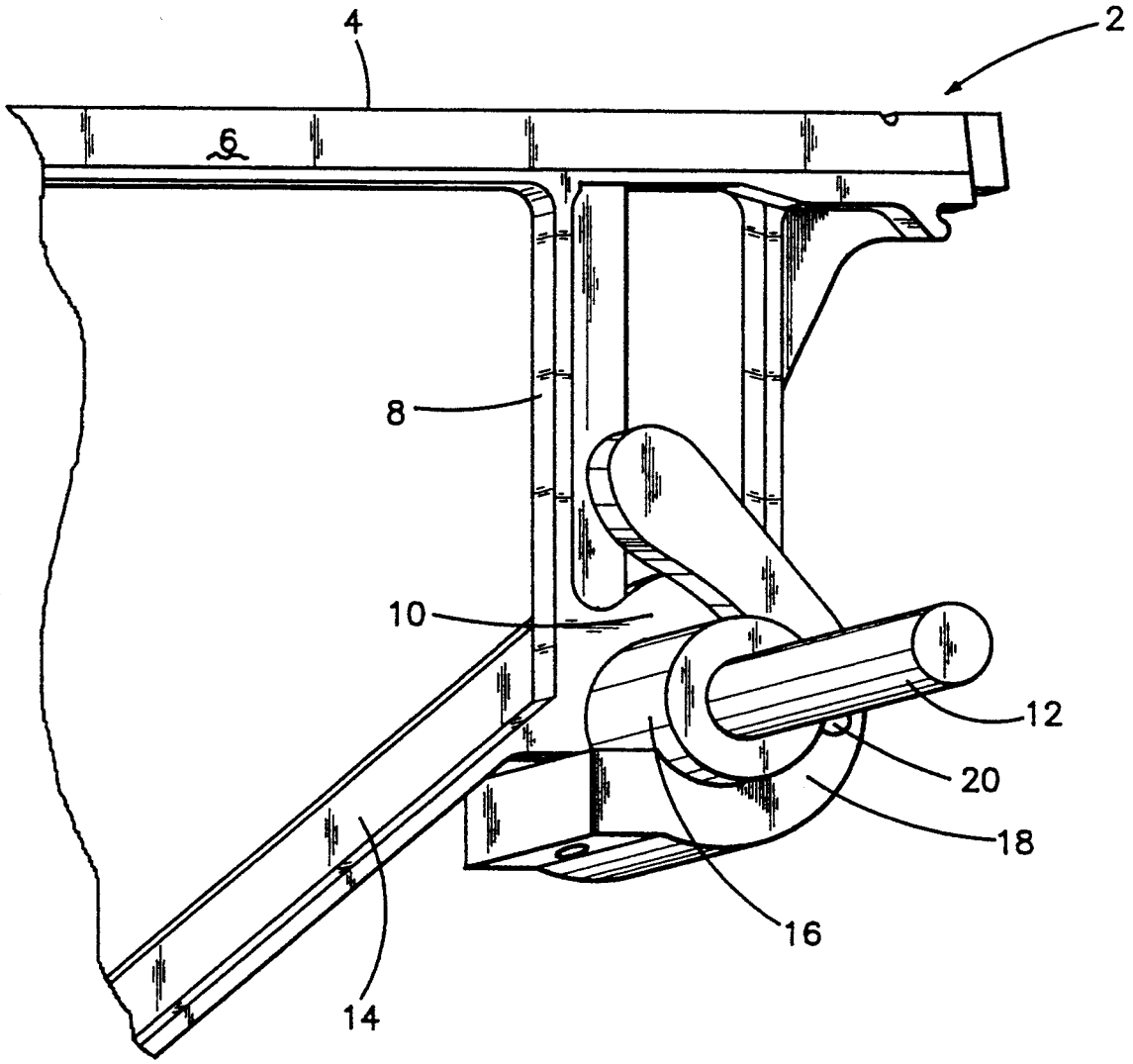
FIG. 1 is a fragmented perspective view of the bottom portion of an escalator step showing a preferred embodiment of the step axle securement assembly of this invention.

Referring now to FIG. 1, a fragment of an escalator step denoted generally by the numeral 2 is shown. The step 2 has a passenger-bearing tread 4 below which is disposed a frame with downwardly depending posts 8 terminating in sockets 10 adapted to receive the step chain axles 12. Struts 14 extend downwardly from the sockets 10 toward the riser portion of the step (not shown). The step chain axles 12 are fitted with elastomeric vibration-absorbing bushings 16 which are received in the sockets 10. C-shaped clamps 18 are mounted on the sockets 10 by means of pivot pins 20 which extend through the clamps 18 and the sockets 10.

Figure 2:
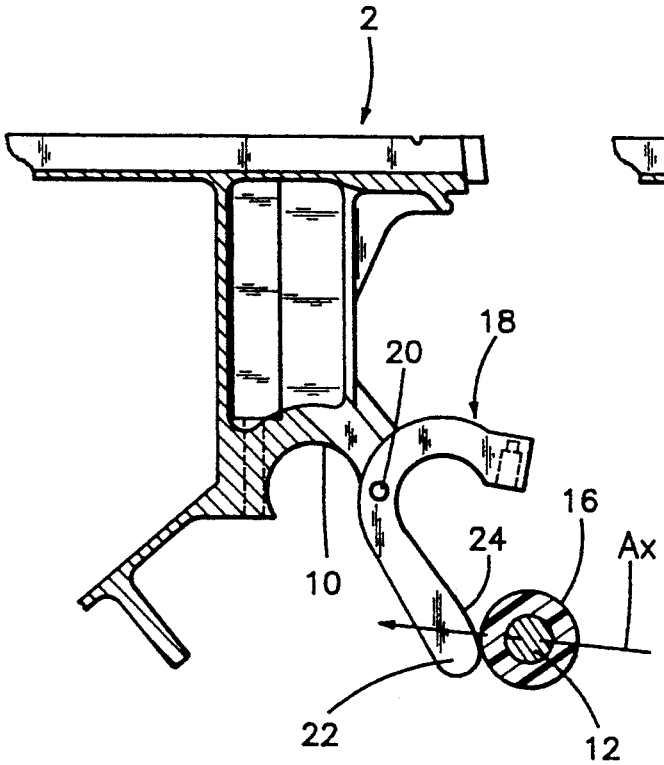
FIGS. 2–4 are fragmented sectional views of the step, step axle, and clamp assembly showing sequentially how the clamp is cammed into proper position by positioning of the axle in the step axle recess.
Figure 3:
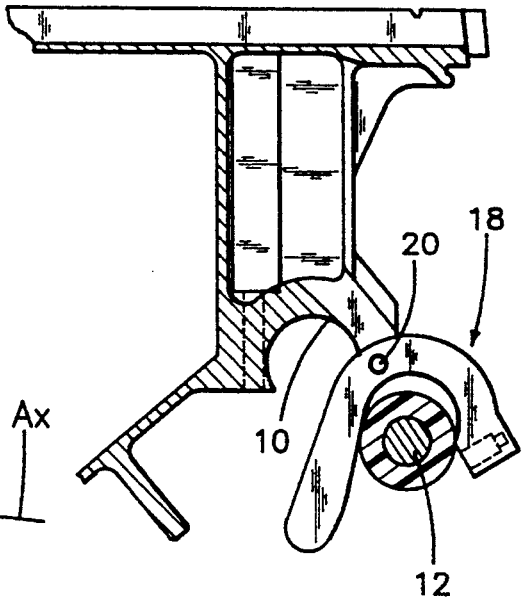
Figure 4:
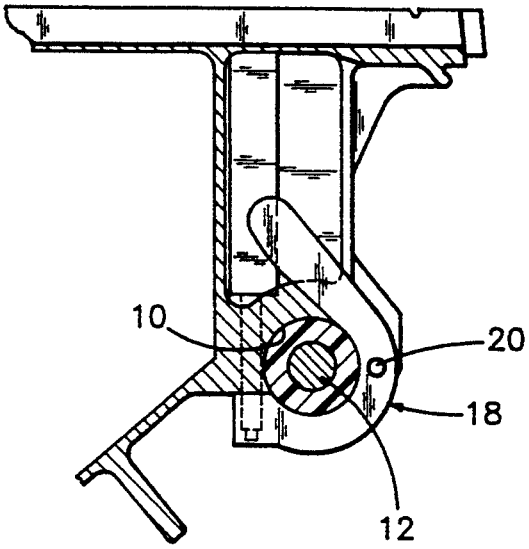

Referring to FIGS. 2–4, the action of the clamp 18 is illustrated as the step chain axle 12 moves into place within step socket 10. It will be noted that the clamp 18 is formed with an extended finger 22 having a curved surface 24 thereon which faces the axle 12. The surface 24 extends down past the path of travel Ax of the axis of the axle 12 as the latter moves into place beneath the axle socket 10. The surface 24 serves to prevent jamming of the clamp 18 and axle 12, and serves to guide the axle 12 into the socket 10. Movement of the axle 12 into the socket 10 causes the clamp 18 to swing around the pivot pin 20 and move into its clamping position, as shown in FIG. 4.

Figure 5:
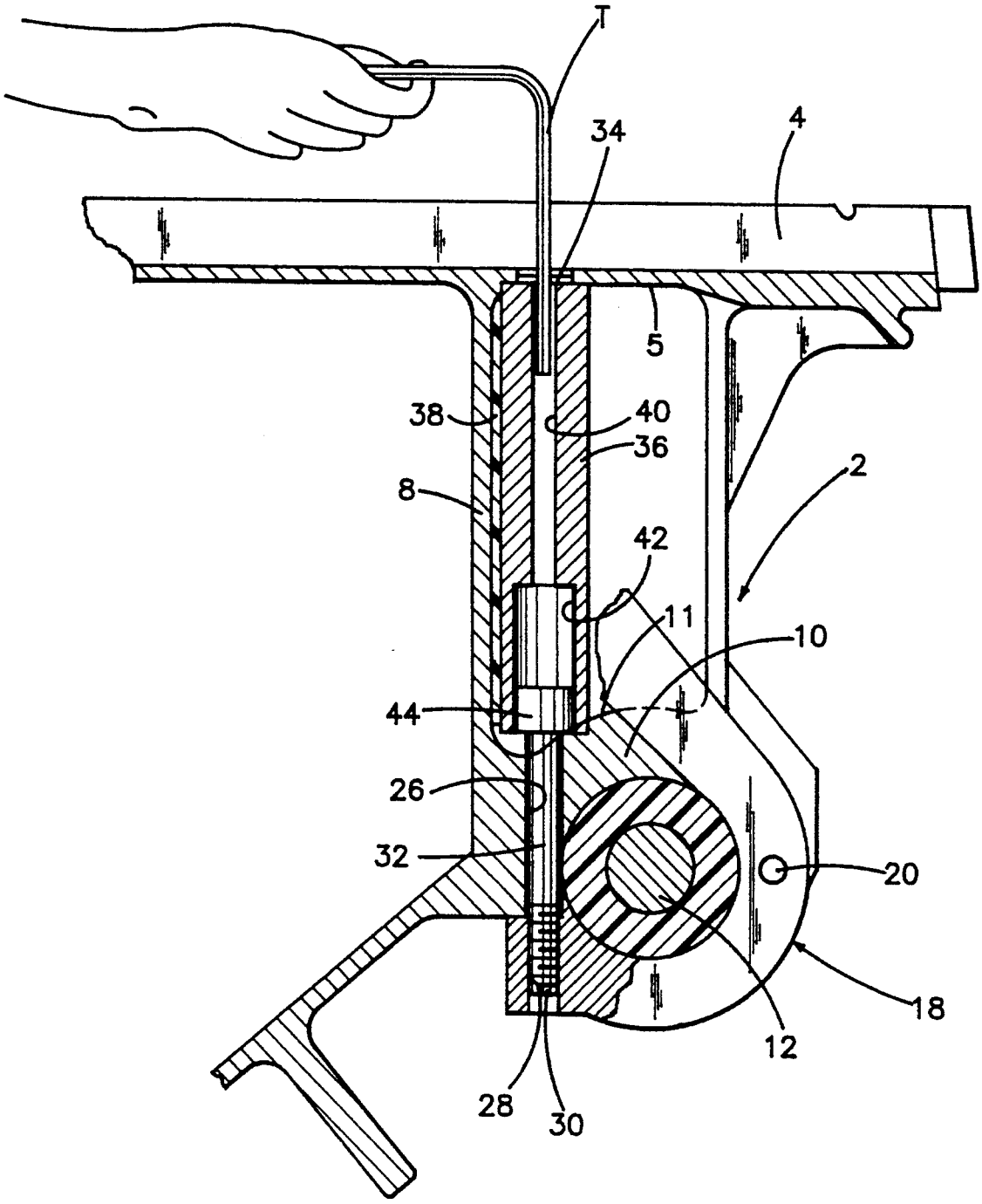
FIG. 5 is a fragmented sectional view of the clamp and axle after the clamp has been bolted in its locked position to the step.

FIG. 5 illustrates the final operation in securing the clamp 18 to the step 2. A bolt passage 26 is formed in the step 2 adjacent to the socket 10, and an aligned bore 28 is formed in the clamp 18. The bore 28 is threaded to receive the threaded end 30 of a fastening bolt 32. The step tread 4 has a drilled hole 34 which is aligned with the bolt passage 26. A guide tube 36 is mounted on the step 2 and secured thereto by a layer of adhesive 38. The tube 36 extends from the undersurface of the tread 4 to the top surface 11 of the socket 10. The tube 36 has a restricted passage 40 formed therein which communicates with the tread hole 34. On the other end, the tube 36 opens into an enlarged counterbore 42. The counterbore 42 is sized to receive an enlarged head 44 formed on the fastening bolt 32. The tube-bolt assembly is put in place as follows. The bolt 32 can be dropped into the bolt passage 26, and the adhesive-coated tube 36 is then positioned over the bolt 32 with the bolt head 44 being disposed in the counterbore 42. The tube 36 is then pressed against the step 8 to adhere to the tube 36 to the step 2. The bolt 44 can thereafter be manipulated by a tool T, such as an Allen wrench, which can engage the bolt 32 via the passage 40 and counterbore 42. When the clamp 18 is released to remove the axle 12 from the step 2, the bolt 32 will remain captive in the bore 26 and tube counterbore 42, and cannot come free of the step 2.

It will be readily appreciated that the step axle attachment assembly of this invention provides a positive guidance of the axle step and clamp into their respective fastening positions by using the camming profile surface on the clamp. In addition, easy and quick access is had to the clamp bolt for manually tightening and loosening of the clamp to fasten or release the axle from the step. The clamp bolt is captured inside of the step assembly and cannot fall away therefrom when the escalator is being serviced.

Since many changes and variations of the disclosed embodiment of the invention may be made without departing from the inventive concept, it is not intended to limit this invention otherwise than as required by the appended claims.

What is claimed is:

1. An escalator or moving walkway step assembly comprising:

a) a step having an upper tread portion carried on support posts which extend downwardly from said tread portion;

b) a step chain axle socket disposed at the bottom of each support post, said sockets being configured to receive a step chain axle;

c) clamp means pivotally mounted on the step adjacent to each of said sockets, said clamp means including socket portions configured to grip the step chain axle, said clamp means also including curvilinear camming fingers extending from said socket portions, said camming fingers being operable to engage the axle as the step axle sockets are moved toward the axle so that said camming fingers slide over the axle to cam said clamp means around the axle and move said socket portions so that said socket portions will intercept the axle prior to pivoting to an axle-clamping position; and means for securing said clamp means in said axle-clamping position.

2. The step assembly of claim 1, wherein said tread portion includes a first opening therethrough; and further comprising a guide tube extending from said first opening downwardly adjacent to said support posts; a second through opening adjacent said axle socket; and wherein said means for securing comprises a threaded port in a part of said clamp means lying beneath said second through opening, and a bolt disposed in said guide tube and extending through said second through opening for threaded securement with said threaded port.

3. The step assembly of claim 2, wherein said guide tube is adhered to said support post.

4. The step assembly of claim 2, wherein said bolt has a diametrically enlarged head and a diametrically smaller stem; and said guide tube has a diametrically enlarged bore adjacent to and larger than said second through opening, and said guide tube having a diametrically reduced bore which is smaller than said bolt head, and which extends from said tread opening to said enlarged bore, and said bolt being captured on the step by reason of the small diameters of said through opening and said reduced bore.

5. An escalator or moving walkway step assembly comprising:

a) a step having an upper tread connected to a support post which extends downwardly from said tread, said tread having an opening therethrough;

b) a step chain axle socket on said step adjacent to said support post;

c) a step chain axle clamp on said step adjacent to said socket;

d) a tool-guiding tube adjacent to said support post and beneath said tread, said tube extending from an undersurface of said tread to said axle socket and said tube having a through passage extending from said tread opening to said axle socket; and e) bolt means in said tube through passage for threadedly engaging said clamp to lock a step chain axle in place in said socket.

6. The step assembly of claim 5, wherein said bolt means has a diametrically enlarged head, and said tool-guiding tube has a diametrically enlarged portion in said through passage, said bolt means head being disposed in said through passage enlarged portion; and means for preventing removal of said bolt means head from said enlarged portion.

7. The step assembly of claim 5 wherein said tube is secured to said support post.

* * * * *